US008499713B2

(12) United States Patent
Nakazawa et al.

(10) Patent No.: US 8,499,713 B2
(45) Date of Patent: Aug. 6, 2013

(54) WATER-BASED COATING APPLICATION SYSTEM

(75) Inventors: Yoshiyuki Nakazawa, Sayama (JP); Masazumi Watanabe, Sayama (JP)

(73) Assignee: Honda Motor Co., Ltd., Tokyo (JP)

( * ) Notice: Subject to any disclaimer, the term of this patent is extended or adjusted under 35 U.S.C. 154(b) by 1228 days.

(21) Appl. No.: 11/992,499

(22) PCT Filed: Aug. 30, 2006

(86) PCT No.: PCT/JP2006/317599

§ 371 (c)(1),
(2), (4) Date: Dec. 4, 2008

(87) PCT Pub. No.: WO2007/034674

PCT Pub. Date: Mar. 29, 2007

(65) Prior Publication Data

US 2009/0104355 A1 Apr. 23, 2009

(30) Foreign Application Priority Data

Sep. 26, 2005 (JP) ..... 2005-278340

(51) Int. Cl.
*B05C 13/00* (2006.01)

(52) U.S. Cl.
USPC ..... 118/63; 118/56; 118/73; 118/300; 427/421.1

(58) Field of Classification Search
USPC ..... 427/421.1; 118/56, 63, 73, 300
See application file for complete search history.

(56) References Cited

U.S. PATENT DOCUMENTS

| | | | | |
|---|---|---|---|---|
| 3,857,511 | A | 12/1974 | Govindan | |
| 4,344,991 | A | 8/1982 | Gray | |
| 5,156,880 | A | 10/1992 | Inculet | |
| 5,683,514 | A * | 11/1997 | Cox et al. | 118/712 |
| 6,620,511 | B1 * | 9/2003 | Wigger et al. | 428/413 |
| 2003/0132116 | A1 | 7/2003 | Gross | |
| 2003/0201182 | A1 | 10/2003 | Nakamura et al. | |
| 2009/0304936 | A1 * | 12/2009 | Nakazawa | 427/348 |

FOREIGN PATENT DOCUMENTS

| | | |
|---|---|---|
| EP | 1243346 | 9/2002 |
| EP | 1327484 | 7/2003 |
| EP | 1340554 | 9/2003 |
| JP | 2000-037640 | 2/2000 |
| JP | 3498941 | 12/2003 |
| JP | 2004033902 A * | 2/2004 |

OTHER PUBLICATIONS

English translation of the abstract for JP2004-033902.*

* cited by examiner

*Primary Examiner* — Robert S Walters, Jr.
(74) *Attorney, Agent, or Firm* — Carrier Blackman & Associates, P.C.; William D. Blackman; Joseph P. Carrier

(57) ABSTRACT

A method for applying a water-based coating (53) to a painted workpiece (49) is provided. The method includes spraying water (51) from an application nozzle unit (10) to the workpiece (49), feeding the water-based coating (53) to the workpiece (49), and finally applying streams of compressed air onto the water-based coating (53) to spread uniformly the water-based coating (53).

6 Claims, 10 Drawing Sheets

36
38
39F
39R
43
45
46F
46R
10
14
21R
21F
11
22R
22F
24R
33F
51
52
49

WATER-BASED COATING APPLICATION SYSTEM

TECHNICAL FIELD

The present invention relates to an apparatus and method for applying a water-based coating to a paint film so as to protect the film.

BACKGROUND ART

Vehicular bodies such as automotive bodies are painted to provide not only improved appearances but also improved resistance to rust. The vehicle bodies would provide less commercial values if paint films formed on the bodies are damaged. The paint films are coated with water-based coatings in order to prevent deterioration of the commercial values.

The water-based coatings need to be evenly applied and spread to provide a uniform thickness, as in the case of painting of the vehicle bodies. Such even application of the water-based coatings is achieved using a nozzle unit disclosed in JP-B-3498941.

The disclosed nozzle unit will be discussed with reference to FIG. 14 hereof. As shown in FIG. 14, the nozzle unit denoted by reference numeral 100 includes a nozzle body 101, a plate member 102, and a plurality of bolts 103 connecting the plate member 102 to the nozzle body 101. The plate member 102 has a horizontal groove 105 for receiving a water-based coating fed from a feed port 104 formed in the nozzle body 101. The plate member 102 has a plurality of discharge passages 106 through which the water-based coating flows out.

Description will be made as to application of the water-based coating, fed from the nozzle unit 100, to a workpiece 110, with reference to FIG. 15.

As shown in FIG. 15, the water-based coating, designated at reference numeral 111, is fed from the nozzle unit 100 to the workpiece 110. Next, a roller 112 presses the protective coating 111 for spreading the coating 111 over the workpiece 110 to provide a protective film 113 on the workpiece 110.

The roller 112 is rotatably supported by levers 115 through pins 114. More specifically, opposite ends of the roller 112 are supported by the levers 115, 115. When the roller 112 is subjected to a reaction force from the workpiece 110, a roller center located furthest from the pins 114 flexes away from the workpiece 110. As a result, the protective film 113 is not rendered uniform in thickness.

Additionally, using the roller 112 for a long time inevitably leaves linear flaws on a surface of the roller 112. These linear flaws of the roller 112 leave a linear pattern on the protective film 113. This results in unpleasant outer appearance of the protective film 113.

There is a demand for an alternative to the above application method using the roller 113.

DISCLOSURE OF THE INVENTION

According to a first aspect of the present invention, there is provided a method for applying a water-based coating to a painted workpiece, the method comprising the steps of: spraying water from an application nozzle unit onto the workpiece; feeding the water-based coating from the application nozzle unit to the workpiece; and applying streams of compressed air onto the water-based coating to uniformly spread the water-based coating.

Water is sprayed onto the workpiece, over a previously applied layer of paint, before the water-based coating is fed to the workpiece. The water-based coating absorbs the water to thereby dilute the water-based coating and provide a reduced viscosity thereto, such that the water-based coating can be more readily uniformly spread over the workpiece under the pressure of the compressed air. As a result, a thin protective film made of the water-based coating can be formed uniformly over the previously applied paint layer coating the workpiece, to thereby protect the paint layer thereon.

Desirably, the spraying step, the feeding step and the applying step are performed while the application nozzle unit moves relative to the workpiece.

According to a second aspect of the present invention, there is provided an application apparatus for applying a water-based coating to a painted workpiece, the apparatus comprising: a movable application nozzle unit; first and second directional control valves; the application nozzle unit including: a block having a coating reservoir defined therein for holding the water-based coating; a nozzle plate having a plurality of discharge ports defined therein for discharging the water-based coating from within the coating reservoir; a feed tube, provided on a top surface of the block, for feeding the water-based coating into the coating reservoir; front and rear plates provided on front and rear surfaces of the block, respectively; a pair of front and rear air-supplying tubes, provided on the front and rear plates, respectively, for supplying compressed air into gaps between the front plate and the front surface of the block and between the rear plate and the rear surface of the block; a pair of front and rear jet ports, defined between the nozzle plate and a lower portion of the front plate and between the nozzle plate and a lower portion of the rear plate, respectively, for emitting jets of the compressed air from the gaps to spread the water-based coating discharged from the discharge ports; a pair of front and rear water-supplying tubes provided on the front and rear plates, respectively; spray ports, defined in the front and rear plates and communicating with the front and rear water-supplying tubes, for spraying pressurized water supplied from the front and rear water-supplying tubes; the first directional control valve allowing supply of compressed air to one of the pair of the air-supplying tubes on the basis of a direction of movement of the application nozzle unit; and the second directional control valve allowing supply of pressurized water to one of the pair of the water-supplying tubes on the basis of the direction of movement of the application nozzle unit.

BEST MODE FOR CARRYING OUT THE INVENTION

Figure 1:
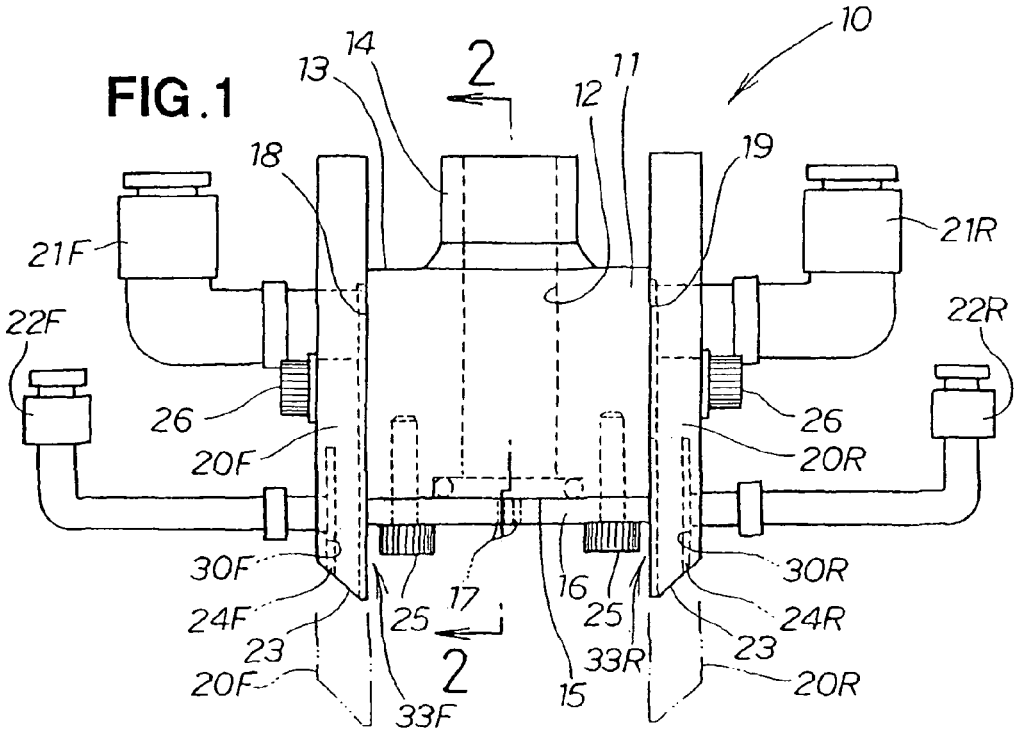
FIG. 1 is a side elevation view of an application nozzle unit for applying a water-based coating, in accordance with the present invention.

Referring to FIG. 1, an application nozzle unit 10 includes a block 11. The block 11 has a coating reservoir 12 defined therein for holding a water-based coating. Provided on a top surface 13 of the block 11 is a feed pipe 14 for feeding a water-based coating into the coating reservoir 12. Provided on a bottom surface 15 of the block 11 is a nozzle plate 16 defining a bottom of the coating reservoir 12. The nozzle plate 16 has a plurality of discharge ports 17 defined therein for discharging the water-based coating from within the coating reservoir 12. Provided on front and rear surfaces 18, 19 of the block 11 are front and rear plates 20F, 20R.

The front plate 20F has a front communication passage 30F communicating with front water-supplying tubes 22F provided on the front plate 20F. The front communication passage 30F also communicates with a set of front spray ports 24F defined on a bottom surface 23 of the front plate 20F. Pressurized water supplied from the front water-supplying tubes 22F is sprayed downwardly out of the front spray ports 24F.

Likewise, the rear plate 20R has a rear communication passage 30R communicating with rear water-supplying tubes 22R provided on the rear plate 520R. The rear communication passage 30R also communicates with a set of rear spray ports 24R defined on a bottom surface 23 of the rear plate 20R. Pressurized water supplied from the rear water-supplying tubes 22R is sprayed downwardly out of the rear spray ports 24R.

Provided on the front plate 20F are front air-supplying tubes 21F for supplying compressed air into a gap (not designated) defined between the front plate 20F and the front surface 18 of the block 11. Provided on the rear plate 20R are rear air-supplying tubes 21R for supplying compressed air to a gap (not designated) defined between the rear plate 20R and the rear surface 19 of the block 11.

The nozzle plate 16 is secured by fasteners 25, 25 to the bottom surface 15 of the block 11. The front and rear plates 20F, 20R are secured by fasteners 26, 26 to the front and rear surfaces 18, 19 of the block 11. The fasteners 25, 26 are preferably bolts.

Figure 2:
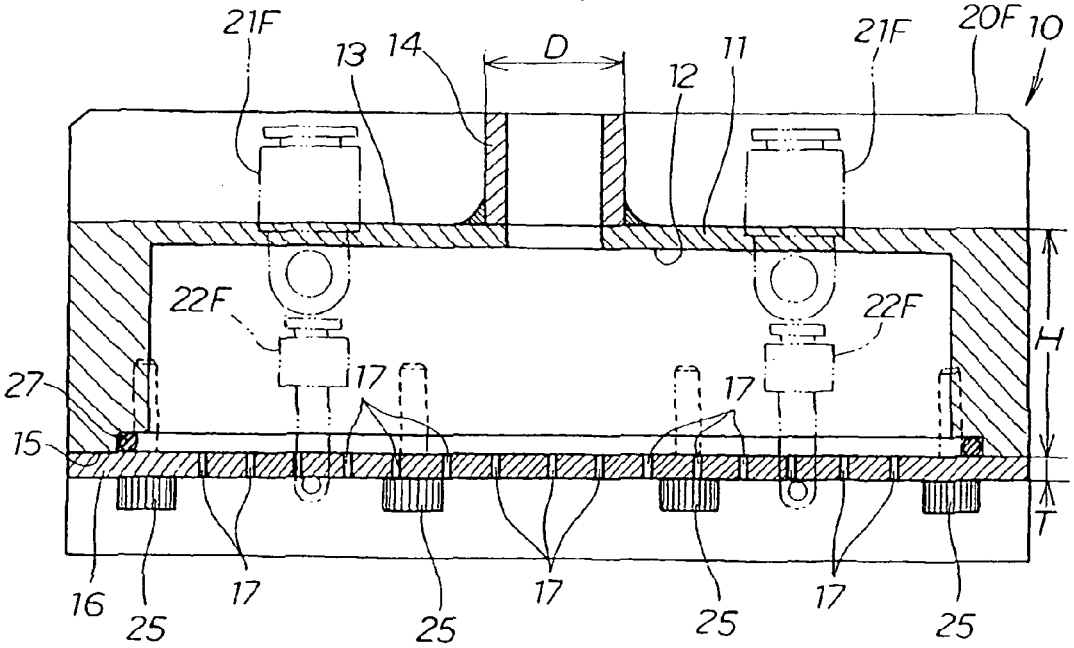
FIG. 2 is a cross-sectional view taken along line 2-2 of FIG. 1.

As shown in FIG. 2, the coating reservoir 12 has a horizontally elongated space defined in the horizontally elongated block 11. The horizontally elongated space of the coating reservoir 12 is closed at its bottom by the nozzle plate 16. Sandwiched between the nozzle plate 16 and the block 11 is an O-ring 27 for providing a hermetic seal therebetween. The feed pipe 14 is positioned centrally in a right-and-left direction of the horizontally elongated coating reservoir 12.

In the illustrated embodiment, the block 11 has a height H of 30 mm. The nozzle plate 16 has a thickness T from 1 to 3 mm. The feed pipe 14 has an outer diameter D of 17 mm.

Discussion will be made as to structure of the front plate 20F with reference to FIG. 3 and FIG. 4.

Figure 3:
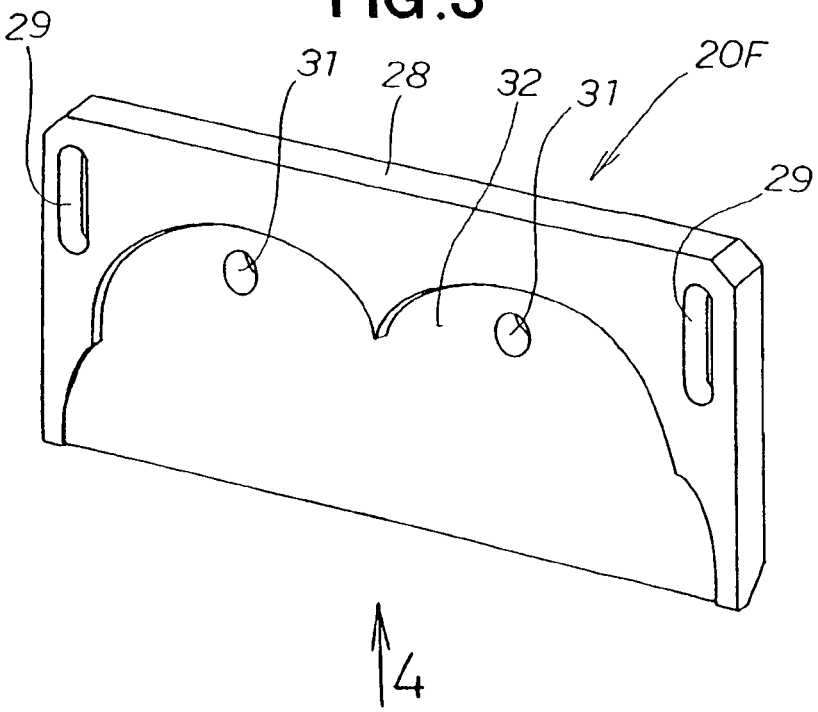
FIG. 3 is a perspective view of a front plate of the application nozzle unit.

As shown in FIG. 3, the front plate 20F is made of a rectangular plate 28. The rectangular plate 28 has right and left vertically-elongated holes 29, 29 defined in right and left end portions of the plate 26. The rectangular plate 28 has a pair of openings 31, 31 defined therein. The plate 28 also has a shallow recessed portion 32 formed at one side thereof for providing flattened streams of compressed air blown from the openings 31, 31.

Figure 4:
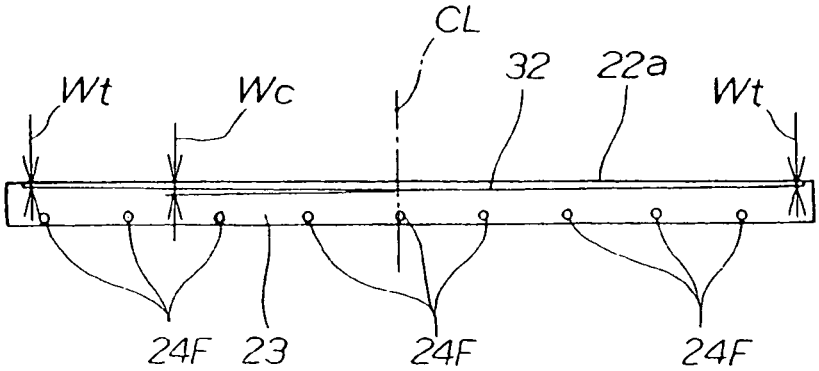
FIG. 4 is a view of the front plate as viewed in a direction of an arrow 4 of FIG. 3.

As shown in FIG. 4, the shallow recessed portion 32 has a depth increasing gradually towards a longitudinally center line CL of the recessed portion 32. Namely, the recessed portion 32 has opposite end portions of depths Wt, Wt smaller than a depth Wc of a central portion of the recessed portion 32. It is to be noted that the rear plate 20R has the same structure as the front plate 20F.

Discussion will be made as to a bottom of the application nozzle unit 10 with reference to FIG. 5.

Figure 5:
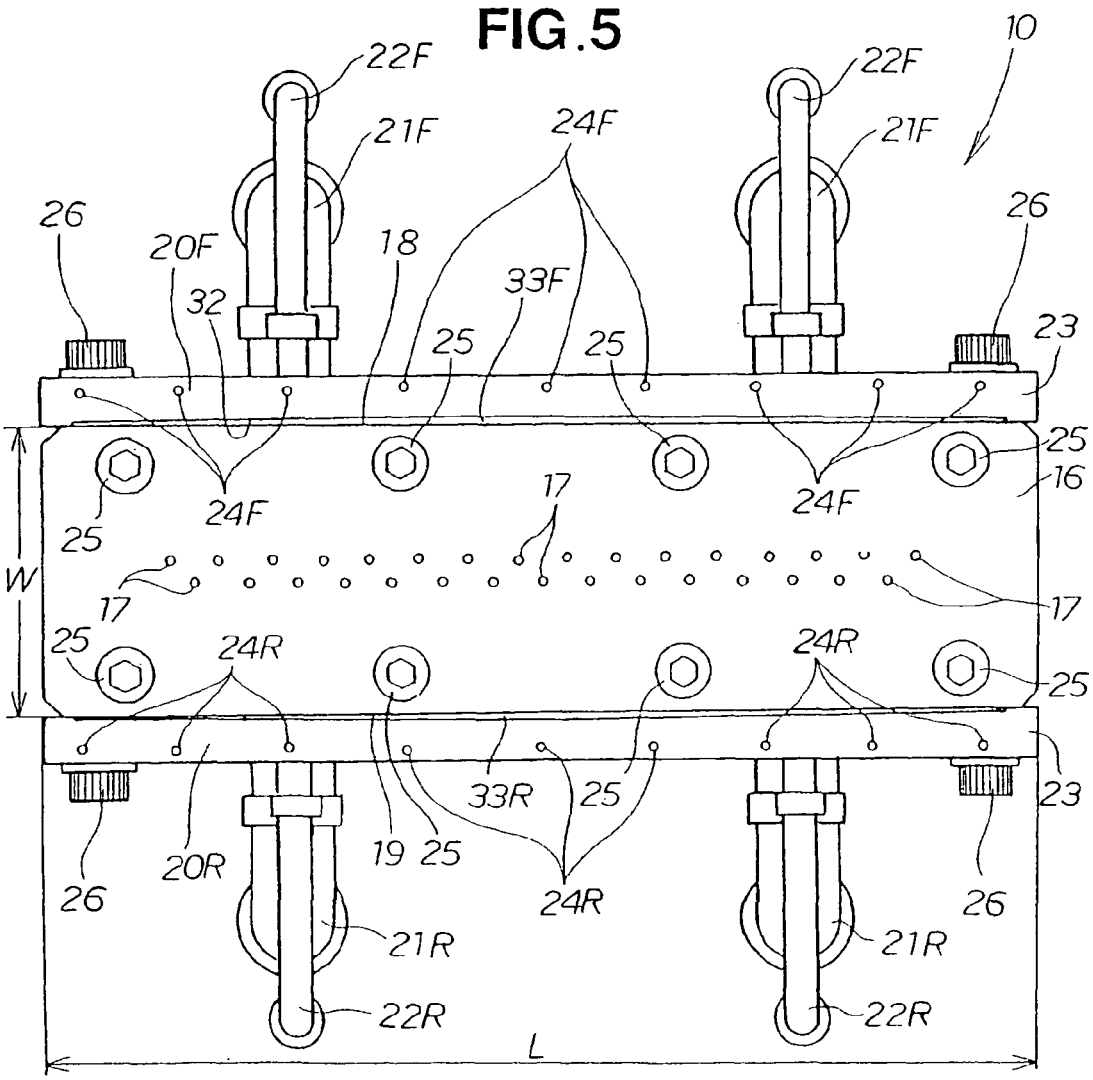
FIG. 5 is a bottom view of the application nozzle unit.

As shown in FIG. 5, the horizontally-elongated nozzle plate 16 has a great number of the discharge ports 17 arranged in two rows. One of the two rows of the discharge ports 17 is horizontally displaced relative to the other row by one half of a pitch between adjacent discharge ports 17. The discharge ports 17 in the two rows are arranged in a staggered fashion.

Between a lower portion of the front plate 20F and a front long side of the horizontally-elongated nozzle plate 16, there is defined a front jet port 33F for emitting a jet of compressed air.

Similarly, between a lower portion of the rear plate 20R and a rear long side of the horizontally-elongated nozzle plate 16, there is defined a rear jet port 33R for emitting a jet of compressed air.

The front jet port 33F communicates with the gap defined between the front plate 20F and the front surface 18 of the block 11 (see FIG. 1). Likewise, the rear jet port 33R communicates with the gap defined between the rear plate 20R and the rear surface 19 of the block 11.

In the illustrated embodiment, the nozzle plate 16 has a length L of 120 mm and a width W of 35 mm.

The number of the discharge ports 17 defined in the nozzle plate 16 is determined by a width of an area to be coated with the water-based coating. For example, where such a width is 90 mm, fifteen discharge ports 17 each having a diameter from 0.4 to 0.6 mm are arranged in a row at pitches of 6 mm while fourteen discharge ports 17 each having a diameter from 0.4 to 0.6 mm are arranged in a row at pitches of 6 mm. Namely, a total of twenty nine discharge ports 17 is provided in a staggered fashion. Alternatively, thirty two discharge ports 17 each having a diameter from 0-4 to 0.6 mm may be arranged in a row at pitches of 3 mm while thirty one discharge ports 17 each having a diameter from 0.4 to 0.6 mm may be arranged in a row at pitches of 3 mm. In this case, a total of sixty three discharge ports 17 is provided in a staggered fashion. Alternatively, the nozzle plate 16 may have only one row of fifteen discharge ports 17 arranged at pitches of 6 mm.

Where a width of an area to be coated with a water-based coating is 48 mm, eight discharge ports 17 each having a diameter from 0.4 to 0.6 mm are arranged in a row at pitches of 6 mm while seven discharge ports 17 each having a diameter from 0.4 to 0.6 mm are arranged in a row at pitches of 6 mm. A total of fifteen discharge ports 17 is arranged in a staggered fashion. Alternatively, sixteen discharge ports 17 each having a diameter from 0.4 to 0.6 mm may be arranged in a row at pitches of 3 mm while fifteen discharge ports 17 each having a diameter from 0.4 to 0.6 mm may be arranged in a row at pitches of 3 mm. In this case, a total of thirty one discharge ports 17 is arranged in a staggered fashion. Alternatively, the nozzle plate 16 may have only one row of eight discharge ports 17 arranged at pitches of 6 mm.

Figure 6:
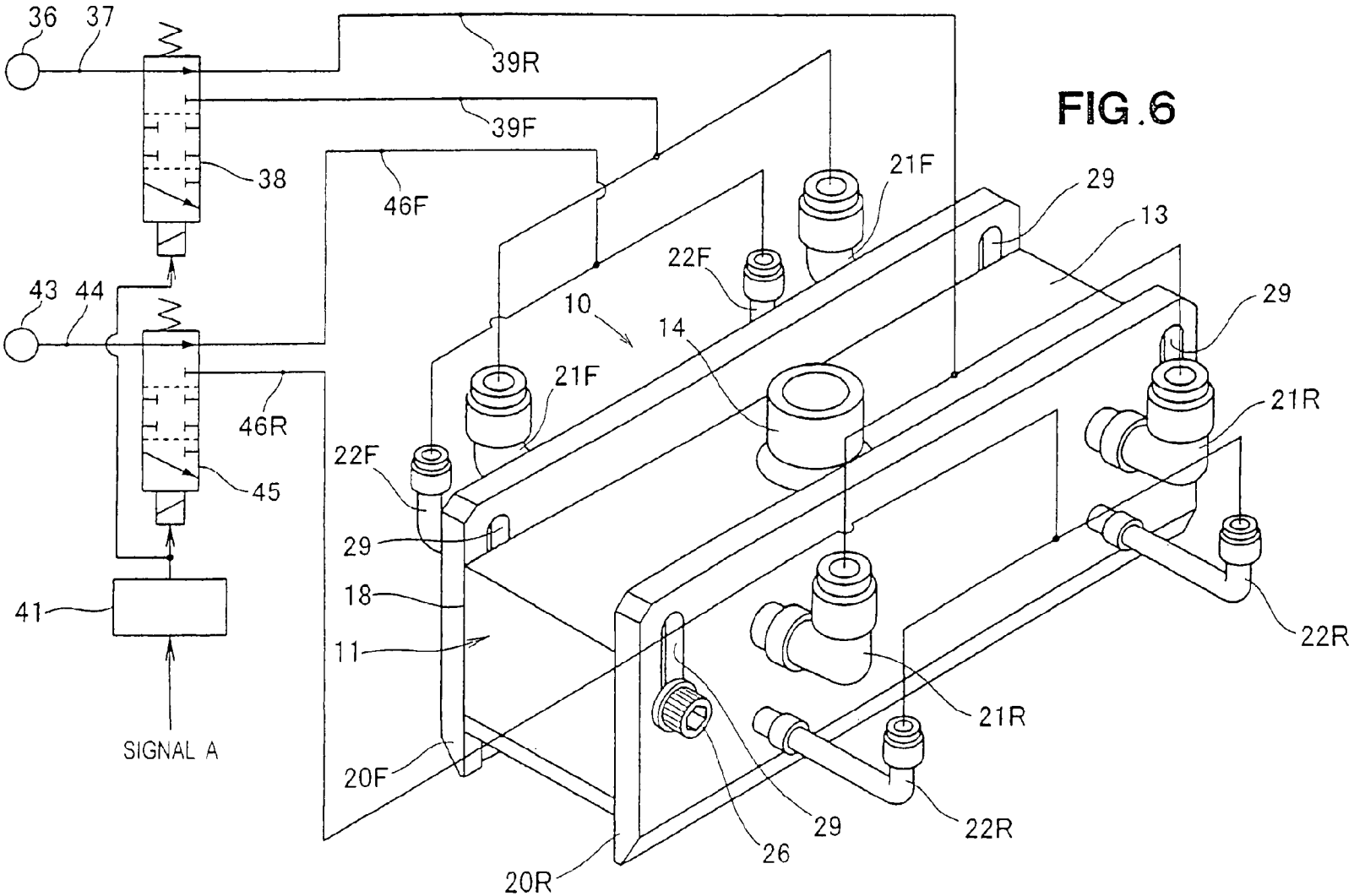
FIG. 6 is a perspective view of the application nozzle unit and first and second directional control valves.

Reference is made to FIG. 6. The front and rear plates 20F, 20R are disposed on front and rear sides of the block 11. By loosening the fasteners 26, 26, it becomes possible to move the plates 20F, 20R vertically a distance equal to or less than a length of the elongated hole 29.

A main air tube 37 extending from a source 36 of compressed air has a distal end connected to a first directional control valve 38. The valve 38 is designed to allow the air to flow to one of two air tubes (front and rear air tubes) 39F, 39R extending from the valve 38. The front air tube 39F is connected to the front air-supplying tubes 21F, 21F. The rear air tube 39R is connected to the rear air-supplying tubes 21R, 21R. The first directional control valve 38 is controlled by a valve control section 41. The valve control section 41 receives a signal A indicative of information on a direction of movement of the application nozzle unit 10.

A main water tube 44 extending from a source 43 of pressurized water has a distal end connected to a second directional control valve 45. The valve 45 is designed to allow the water to flow to one of two water tubes (front and rear water tubes) 46F, 46R extending from the valve 45. The front water tube 46F is connected to the front water-supplying tubes 22F, 22F. The rear water tube 46R is connected to the rear water-supplying tubes 22R, 22R. The second directional control valve 45 is controlled by the valve control section 41, as is the first directional control valve 38.

Next, operation of the application nozzle unit 10 will be discussed.

Figure 7:
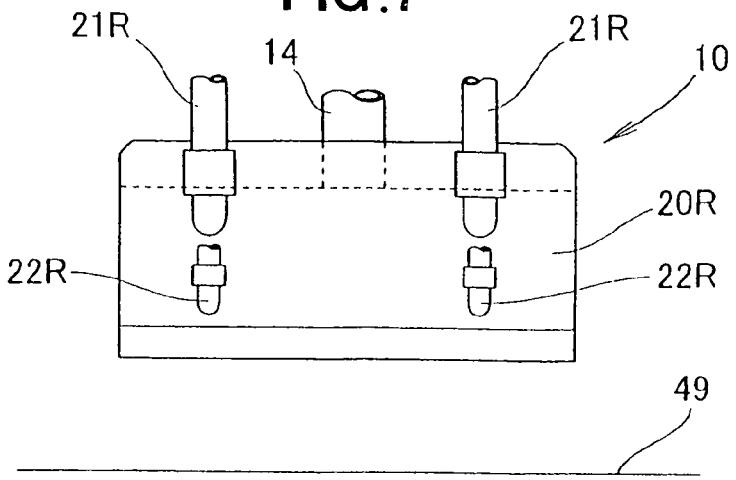
FIG. 7 is a view showing a step of setting a painted workpiece in opposed relation to the application nozzle unit.

As shown in FIG. 7, a painted workpiece 49 is set facing towards the application nozzle unit 10.

Figure 8:
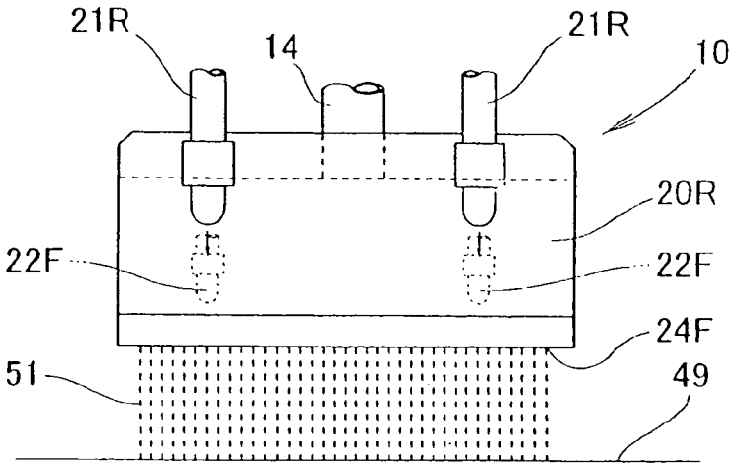
FIG. 8 is a view showing a step of spraying pressurized water from the application nozzle unit to the workpiece.

The operation of the application nozzle unit 10 starts from a step of spraying pressurized water 51 from the front spray ports 24F onto the workpiece 49, as shown in FIG. 8.

Figure 9:
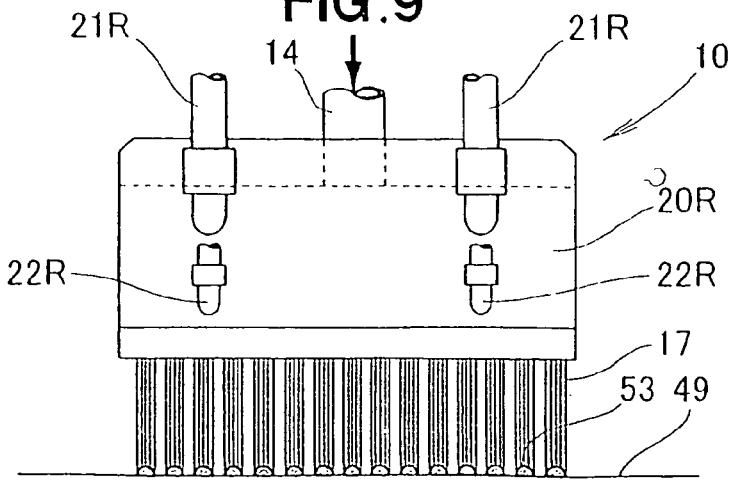
FIG. 9 is a view showing a step of feeding the water-based coating from the application nozzle unit to the workpiece.

The operation of the application nozzle unit 10 then proceeds to a step of feeding a water-based coating 53 to the workpiece 49. More specifically, as shown in FIG. 9, the water-based coating 53 is discharged out through the discharge ports 17 onto the workpiece 49 and absorbs the sprayed water. While discharging the coating 53, the application nozzle unit 10 moves forward (in a direction directed down out of a plane of FIG. 8).

Figure 10A:
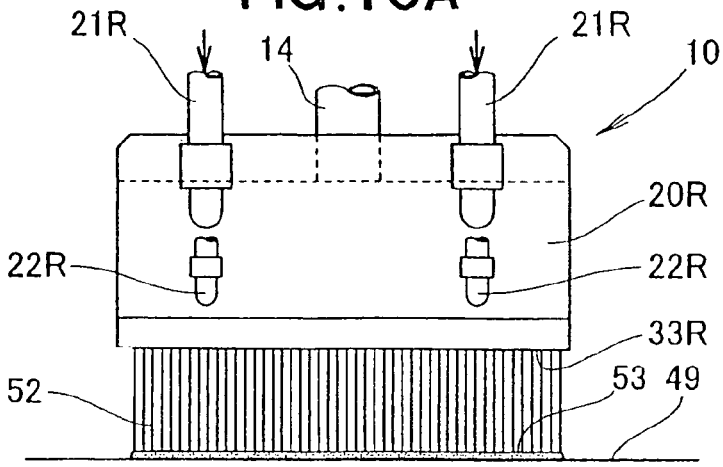
FIG. 10A is a view showing a step for applying compressed air onto the water-based coating on the workpiece to level a surface of the water-based coating.

The operation of the application nozzle unit 10 proceeds to a step of leveling a surface of the water-based coating 53 on the workpiece 49. More specifically, as shown in FIG. 10A, the water-based coating 53 is uniformly spread under pressure of compressed air 52 jetting from the rear jet port 33R. Since the water-based coating 53 has absorbed the water 51, the water-based coating 53 increases in fluidity so that it is easily uniformly spread over the workpiece 49 under the pressure of the compressed air 52.

Figure 10B:
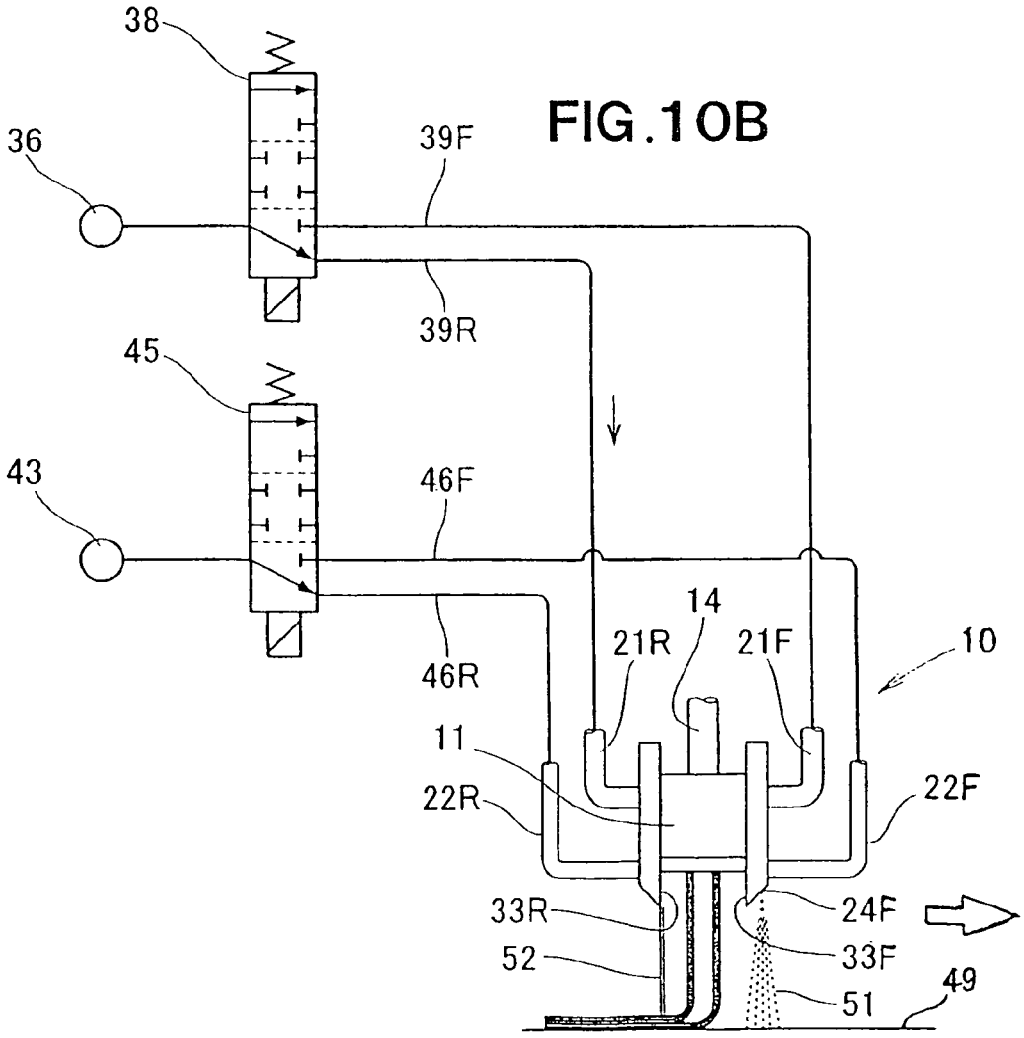
FIG. 10B is a view showing operation of the first and second directional control valves for allowing the compressed air and the pressurized water to be supplied to the application nozzle unit when the application nozzle unit moves forward.

As shown in FIG. 10B, the front and rear jet ports 33F, 33R are located forwardly and rearwardly of the discharge ports 17 (FIG. 1), respectively. When the application nozzle unit 10 moves forward (rightward of FIG. 10B), as shown by a profiled arrow of FIG. 10B, the first directional control valve 38 is operated to allow compressed air to be supplied through the rear air tube 39R to the rear air-supplying tubes 21R, 21R, such that the compressed air, designated at reference numeral 52, jets from the rear jet port 33R to the water-based coating.

Figure 10C:
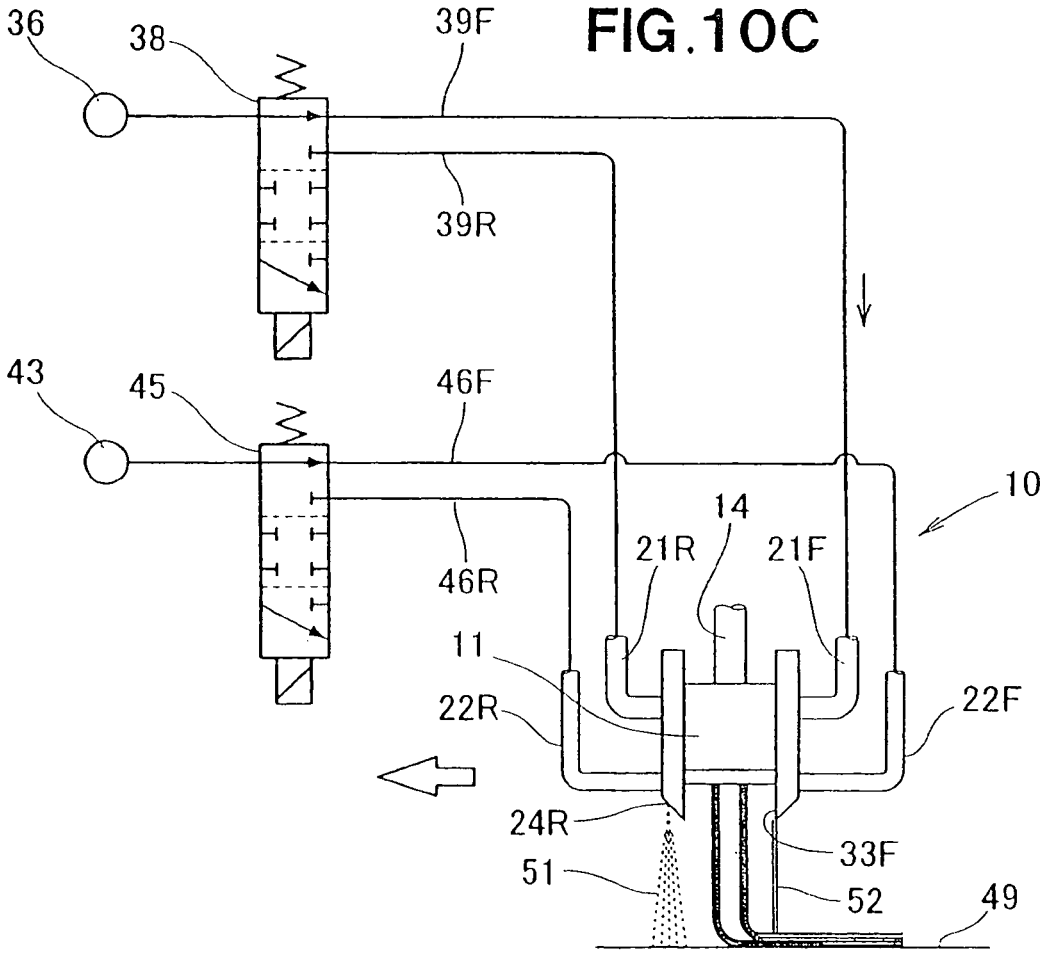
FIG. 10C is a view showing operation of the first and second directional control valves for allowing the compressed air and the pressurized water to be supplied to the application nozzle unit when the application nozzle unit moves rearward.

On the other hand, when the application nozzle unit 10 moves rearward (leftward of FIG. 10C), as shown by a profiled arrow of FIG. 10C, the first directional control valve 38 is operated to allow compressed air to be supplied through the front air tube 39F to the front air-supplying tubes 21F, 21F, such that the compressed air, denoted by reference numeral 52, jets from the front jet port 33F to the water-based coating.

When the application nozzle unit 10 moves forward (rightward of FIG. 10B), the second directional control valve 45 is operated to allow pressurized water to be supplied through the front water tube 46F to the water-supplying tubes 22F, 22F, such that the pressurized water designated at reference numeral 51 is sprayed downwardly from the front spray ports 24F onto the workpiece 49.

On the other hand, when the application nozzle unit to moves rearward (leftward of FIG. 10C), the second directional control valve 45 is operated to allow pressurized water to be supplied through the water tube 46R to the water-supplying tubes 22R, 22R, such that the pressurized water designated at reference numeral 51 is sprayed downwardly from the rear spray ports 24R onto the workpiece 49.

Namely, while the application nozzle unit 10 moves to and fro (rightward and leftward in FIG. 10B or 10C), the first directional control valve 35 and the second directional control valve 45 are operated such that the compressed air jets from the corresponding jet port to the water-based coating and the pressurized water is sprayed downwardly from the corresponding set of spray ports to the workpiece 49. Because the application nozzle unit 10 moves reciprocally without having to make any turn, an applying operation can be more efficiently performed imposing a reduced burden on a robot.

In the illustrated embodiment, the water-based coating, immediately after applied to the workpiece 49, is in the form of a wet film having a thickness of 120 μm to 200 μm, preferably, 160 μm.

Discussion will be made as to a case where a diameter of the discharge port 17 is set to be equal to or less than 1 mm, and a case where a diameter of the discharge port 17 is set to exceed 1 mm.

Figure 11A:
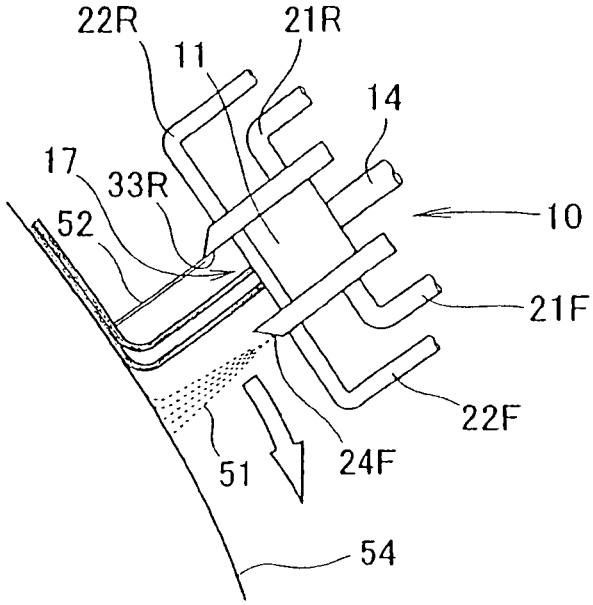
FIG. 11A is a view showing an operation of the application nozzle unit having discharge ports of diameters of 1 mm or less.

As shown in FIG. 11A, the discharge ports 17 each having a diameter of 1 mm or less, preferably, in the range of 0.4 to 0.6 mm, discharge a water-based coating to a steep surface 54 of a workpiece (not designated). As a result, the water-based coating is put in the form of a thin line on the steep surface 54. This water-based coating is rapidly spread over the surface 54 under pressure of compressed air 52 jetting from the rear jet port 33R.

Figure 11B:
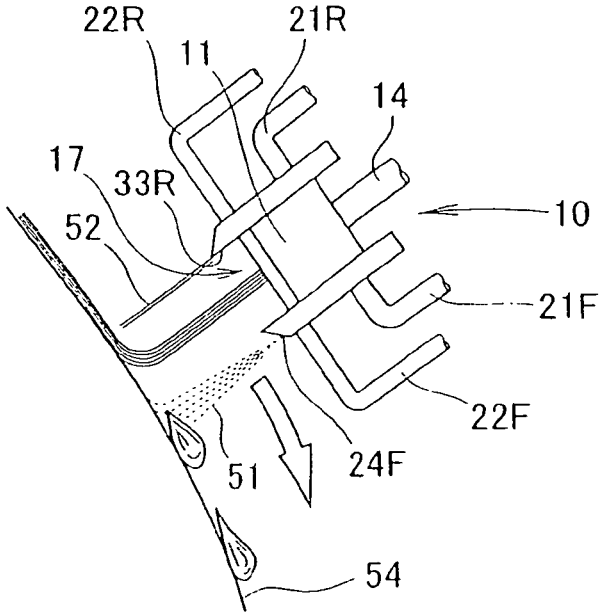
FIG. 11B is a view showing an operation of an application nozzle unit having discharge ports of diameters exceeding 1 mm.

As shown in FIG. 11B, the discharge ports 17 each having a diameter exceeding 1 mm, discharge the water-based coating to a steep surface 54 of a workpiece (not designated). As a result, the water-based coating is put in the form of a thick line on the surface 54. This water-based coating can not be sufficiently spread over the surface 54 under pressure of compressed air 52 jetting from the rear jet port 33R. In addition, parts of the water-based coating descend in the form of drops along the surface 54.

Thus, it is found that the diameter of the discharge port 17 set to be 1 mm or less, preferably, in the range of 0.4 to 0.6 mm is effective.

The shape of the discharge ports 17 are not limited to circular but may be square, rectangular or octagonal. The discharge ports 17 are designed to be small in size on the basis of viscosity and thixotropy of the water-based coating. The thixotropy means a property of varying in viscosity when the coating is subjected to a shearing force.

A modification to the front plate shown in FIG. 4 will be described with reference to FIG. 12.

Figure 12:
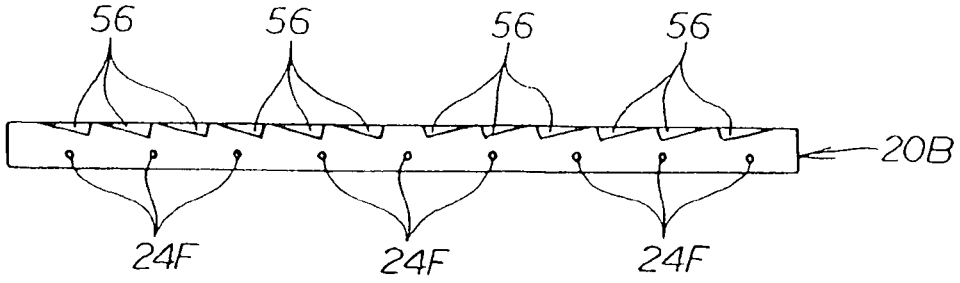
FIG. 12 is a view showing a modification to a front plate shown in FIG. 4.

As shown in FIG. 12, the modified front plate designated at reference numeral 20B is made of a rectangular plate 28 having on one side surface a plurality of groove portions 56 of V-shaped cross-sections, in place of the shallow recessed portion shown in FIG. 4. The groove portions 56 have their individually set depths. Namely, the depth of the groove portion 42 is easier to set than that of the recessed portion 32. It will be appreciated that the rear plate 20R may be modified to provide the same construction as the modified front plate 20B.

Figure 13:
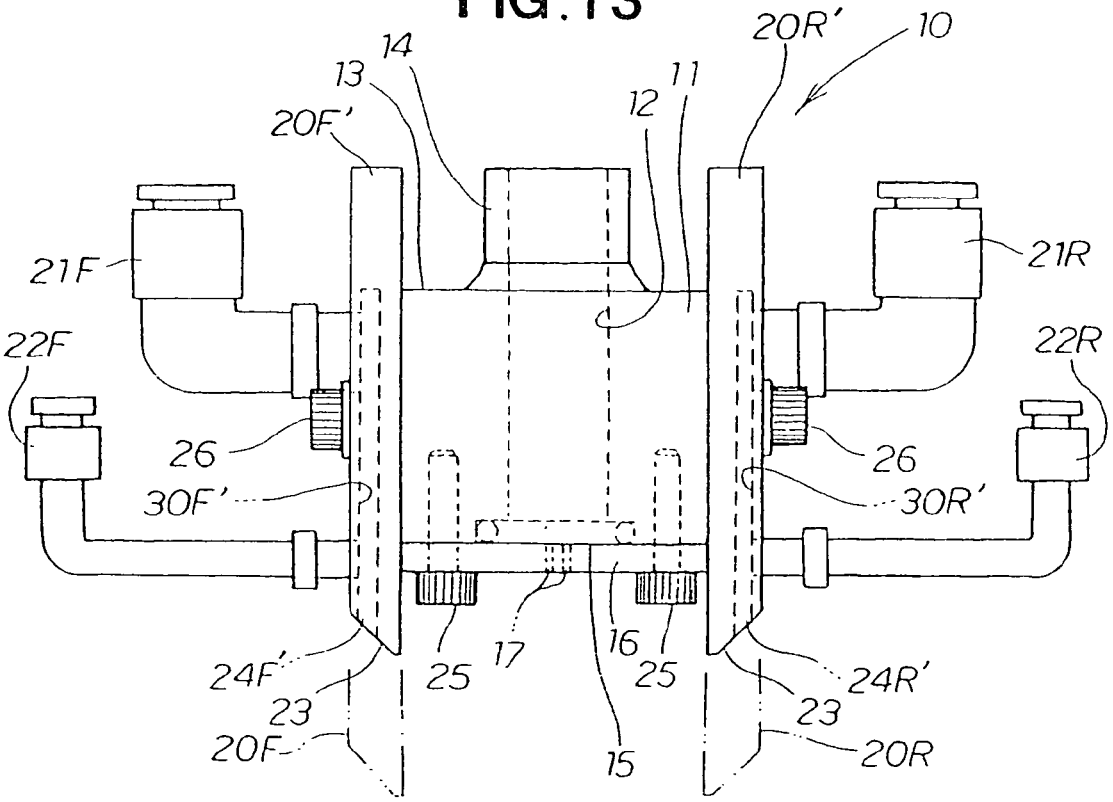
FIG. 13 is a view showing another modification to front and rear plates of the application nozzle unit shown in FIG. 1.
Figure 14:
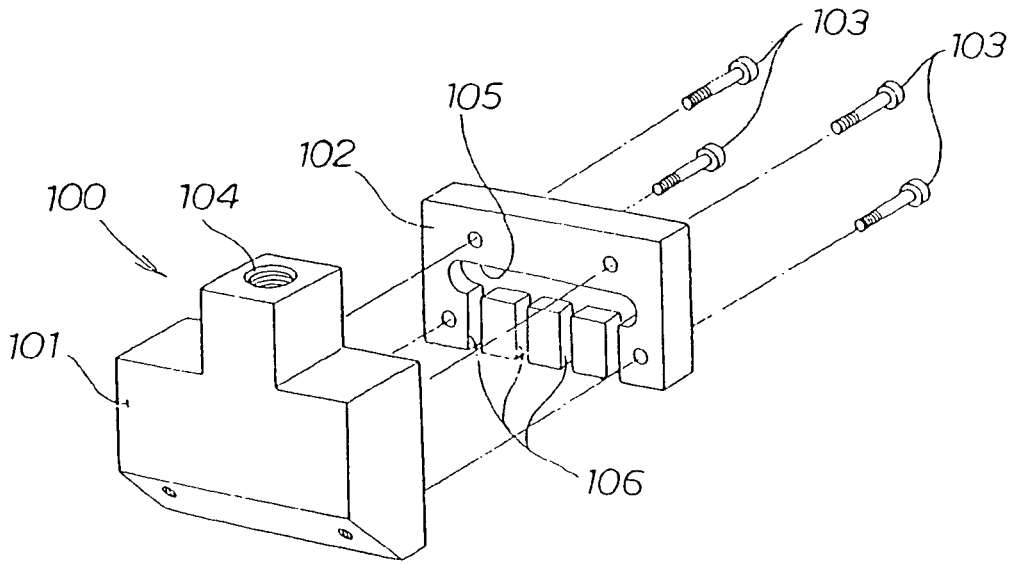
FIG.14 (PRIOR ART)
FIG. 14 is an arrangement of a conventional application nozzle unit.
Figure 15:
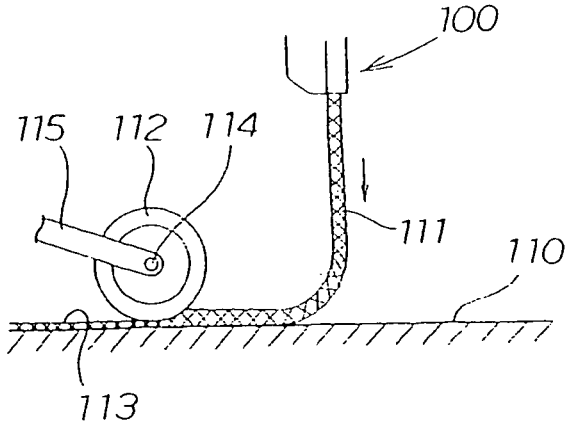
FIG.15 (PRIOR ART)
FIG. 15 is a view showing an operation of the application nozzle unit shown in FIG. 14.

FIG. 13 shows another modification to the front and rear plates 20F, 20R discussed above. The modified front and rear plates designated at reference numerals 20F', 20R', respectively, have communication passages 30F', 30R' defined therein. The communication passage 30P' of the front plate 20F' communicates with both the air-supplying tube 21F and the water-supplying tube 22F while the communication passage 30R' of the rear plate 20R' communicates with both the air-supplying tube 21R and the water-supplying tube 22R.

The front plate 20F' has front ports 24F' defined on the bottom surface 23 thereof. The front ports 24F' communicate with the communication passage 30F'. Similarly, the rear plate 20R' has rear ports 24R' defined on the bottom surface 23 thereof. The rear ports 24R' communicate with the communication passage 30R'.

Although the preferred embodiments of the present invention has been described as to protection of a paint film formed on a workpiece, the present invention is also applicable to protection of paint films formed on vehicle bodies, machines and the like.

INDUSTRIAL APPLICABILITY

The application method and apparatus of the present invention are useful in applying a water-based coating to a painted vehicle body.

The invention claimed is:

1. An application apparatus for applying a water-based coating to a painted workpiece, the apparatus comprising:

a movable application nozzle unit; and first and second directional control valves;

wherein the application nozzle unit comprises:

a block having a coating reservoir defined therein for holding the water-based coating;

a nozzle plate having a plurality of discharge ports defined therein for discharging the water-based coating from within the coating reservoir;

a feed tube, provided on a top surface of the block, for feeding the water-based coating into the coating reservoir;

front and rear plates provided on front and rear surfaces of the block, respectively;

a pair of front and rear air-supplying tubes, provided on the front and rear plates, respectively, for supplying compressed air into gaps between the front plate and the front surface of the block and between the rear plate and the rear surface of the block;

a pair of front and rear jet ports, defined between the nozzle plate and a lower portion of the front plate and between the nozzle plate and a lower portion of the rear plate, respectively, for emitting jets of the compressed air from the gaps to spread the water-based coating discharged from the discharge ports;

a pair of front and rear water-supplying tubes provided on the front and rear plates, respectively; and spray ports, defined in the front and rear plates and communicating with the front and rear water-supplying tubes, for spraying pressurized water supplied from the front and rear water-supplying tubes, the first directional control valve allowing supply of compressed air to one of the pair of the air-supplying tubes on the basis of a direction of movement of the application nozzle unit, and the second directional control valve allowing supply of pressurized water to one of the pair of the water-supplying tubes on the basis of the direction of movement of the application nozzle unit.

2. A method of applying a water-based coating to a painted surface of a workpiece, the method comprising the steps of:

providing the application apparatus of claim 1; spraying water from the application nozzle unit onto the workpiece over a previously applied paint layer;

feeding the water-based coating from the application nozzle unit to the workpiece in a manner such that the water-based coating mixes with the sprayed water on said painted surface of the workpiece, thereby diluting the water-based coating and reducing viscosity thereof; and applying at least one flattened stream of compressed air onto the diluted water-based coating via the application nozzle unit, to uniformly spread the diluted water-based coating over said previously applied paint layer.

3. The method of claim 2, wherein the water spraying step, the coating feeding step and the air stream applying step are performed while the application nozzle unit is moving back and forth in a reciprocal motion relative to the workpiece.

4. The method of claim 2, wherein said at least one flattened stream of compressed air is applied substantially vertically downwardly in a substantially linear pattern.

5. The method of claim 2, wherein the workpiece is a component of a vehicle body.

6. The method of claim 2, wherein the water-based coating is applied as a wet film having a thickness in a range of 120 μm to 200 μm.

* * * * *